US007467758B2

(12) United States Patent
Brum

(10) Patent No.: US 7,467,758 B2
(45) Date of Patent: Dec. 23, 2008

(54) REEL-OUT, REEL-IN MAGAZINE AND TOWLINE CARTRIDGE

(75) Inventor: Roger D. Brum, San Juan Capistrano, CA (US)

(73) Assignee: Meggitt Defense Systems, Irvine, CA (US)

( * ) Notice: Subject to any disclaimer, the term of this patent is extended or adjusted under 35 U.S.C. 154(b) by 226 days.

(21) Appl. No.: 11/223,522

(22) Filed: Sep. 9, 2005

(65) Prior Publication Data

US 2007/0057112 A1 Mar. 15, 2007

(51) Int. Cl.
*B65H 75/38* (2006.01)

(52) U.S. Cl. ..... 242/397.3

(58) Field of Classification Search ..... 242/397.2, 242/389, 397.3, 478.2, 390, 390.1, 390.8, 242/390.9, 394, 396, 396.1, 396.5, 397, 240, 242/241; 254/134.3 FT, 134.3 SC, 323, 325, 254/326, 334, 335, 362; 244/1 TD, 3, 135 A, 244/137.4, 3.12; 114/21.1, 21.2; 89/1.34; 83/707, 856

See application file for complete search history.

(56) References Cited

U.S. PATENT DOCUMENTS

| | | | |
|---|---|---|---|
| 715,691 | A | 12/1902 | Porter, Jr. |
| 1,097,721 | A | 5/1914 | Koch |
| 1,206,676 | A | 11/1916 | Cote |
| 1,531,926 | A | 3/1925 | Hallot |
| 2,119,550 | A | 6/1938 | Loughridge |
| 2,156,294 | A | 5/1939 | Kessenich |
| 2,381,130 | A | 8/1945 | Lloyd |
| 2,396,071 | A | 3/1946 | Anderson et al. |
| 2,448,343 | A | 8/1948 | Zandmer |
| 2,486,999 | A | 11/1949 | Tapp et al. |
| 2,523,738 | A | 9/1950 | Trimbach |
| 2,551,596 | A | 5/1951 | Haglund |
| 2,751,167 | A | 6/1956 | Hopper et al. |
| 2,760,777 | A | 8/1956 | Cotton |
| 2,813,719 | A | 11/1957 | Hopper |
| 2,898,588 | A | 8/1959 | Graham |
| 2,907,536 | A | 10/1959 | Von Zborowski |
| 2,923,549 | A | 2/1960 | Hopper et al. |
| 2,953,377 | A | 9/1960 | Brust |
| 2,967,683 | A | 1/1961 | Crater |
| 2,967,688 | A | 1/1961 | Sachers |
| 2,998,754 | A | 9/1961 | Bialy |
| 3,002,708 | A | 10/1961 | Wetzel et al. |
| 3,065,967 | A | 11/1962 | Humprey et al. |

(Continued)

*Primary Examiner*—Peter M Cuomo
*Assistant Examiner*—William E Dondero
(74) *Attorney, Agent, or Firm*—Stetina Brunda Garred & Brucker

(57) ABSTRACT

Provided is a reel-out reel-in apparatus that is specifically configured to rapidly deploy and retrieve a towed device such as an aerial decoy towed behind an aircraft. The reel-out reel-in apparatus comprises a spool, a towline wound around the spool and connected to the towed device, a drive mechanism for rotating the spool during retrieval of the towed device, and an electronically controlled levelwind assembly. The levelwind assembly is adapted to evenly distribute the towline across a spool width of the spool during retrieval of the towed device. In addition, the apparatus may include a towline cartridge which integrates the spool, towline and levelwind assembly and a braking mechanism into a single, replaceable unit. The levelwind assembly is adapted to accommodate towlines of variable diameters and is also operative to sever the towline on command by driving the towline into a cutter assembly.

13 Claims, 9 Drawing Sheets

U.S. PATENT DOCUMENTS 3,095,814 A 7/1963 Jansen et al.
3,135,511 A 6/1964 Norman et al.
3,188,052 A 6/1965 Longworth
3,225,655 A 12/1965 Inglis
3,410,559 A 11/1968 Miller, Jr. et al.
3,415,520 A 12/1968 Woodward
3,505,926 A 4/1970 Johnson
3,587,474 A 6/1971 Fuchs
3,589,632 A 6/1971 Rew
3,610,096 A 10/1971 Bauman et al.
3,720,167 A 3/1973 Mainhardt et al.
3,735,985 A 5/1973 Layer et al.
3,808,941 A 5/1974 Biggs
3,871,321 A 3/1975 Giebel et al.
3,898,661 A 8/1975 Kelly et al.
3,899,975 A 8/1975 Lawrence
3,932,057 A 1/1976 Wadensten
4,029,298 A 6/1977 Lassche
4,062,112 A 12/1977 Lake
4,125,812 A 11/1978 Polonio
4,127,295 A 11/1978 Robinson
4,140,433 A 2/1979 Eckel
4,195,571 A 4/1980 Becker et al.
4,205,848 A 6/1980 Smith et al.
4,235,394 A * 11/1980 Fry ..... 242/397.3
4,366,962 A 1/1983 Campbell et al.
4,406,227 A 9/1983 Beeker et al.
4,416,429 A 11/1983 Jessamine
4,428,583 A 1/1984 Feagle
4,446,793 A 5/1984 Gibbs
4,469,196 A 9/1984 Sadler
4,496,159 A 1/1985 Dugan et al.
4,500,048 A 2/1985 Schaller
4,598,882 A 7/1986 Opdahl
4,607,849 A 8/1986 Smith et al.
4,621,579 A 11/1986 Badura et al.
4,718,320 A 1/1988 Brum
4,718,329 A 1/1988 Nakajima et al.
4,756,489 A 7/1988 De Varennes
4,770,368 A 9/1988 Yates et al.
4,796,539 A 1/1989 Berrett
4,852,455 A 8/1989 Brum
4,860,657 A 8/1989 Steinicke et al.
4,883,232 A 11/1989 Marchetti
4,899,662 A 2/1990 Santalucia
4,993,276 A 2/1991 Edwards
5,074,216 A 12/1991 Dunne et al.
5,094,405 A 3/1992 Brum
5,102,063 A 4/1992 Brum
5,179,778 A 1/1993 Dickson et al.
5,249,924 A 10/1993 Brum
5,257,746 A 11/1993 Norrvi et al.
5,445,078 A 8/1995 Marion
5,480,102 A * 1/1996 Sato ..... 242/310
5,499,582 A 3/1996 Schiessl et al.
5,501,411 A 3/1996 Brum et al.
5,551,545 A * 9/1996 Gelfman ..... 191/12.2 A
5,570,854 A 11/1996 Brum et al.
5,836,535 A 11/1998 Brum
5,915,694 A 6/1999 Brum
6,055,909 A 5/2000 Sweeny
6,116,606 A 9/2000 Brum et al.
6,308,907 B1 * 10/2001 Bartkowiak ..... 242/477.2
6,499,407 B2 12/2002 Brum

* cited by examiner

REEL-OUT, REEL-IN MAGAZINE AND TOWLINE CARTRIDGE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to towed vehicles such as aerial targets and decoys and, more particularly, to a uniquely configured apparatus which allows for rapid reel out and reel in of a decoy that may be towed behind an aircraft.

In military applications, towed devices or vehicles are well known and are often used for weapons/gunnery practice and in aircraft protection. Such towed vehicles may include aerial towed decoys. Such decoys may be used to draw various types of guided weapons away from aircraft that the weapons are intended to destroy. More specifically, decoys may typically include electronics which are used to create an apparent target to a weapon in order to draw the weapon toward the decoy and away from the aircraft. Such weapons may include surface-to-air missiles and air-to-air missiles and may also include heat-seeking missiles.

Decoys are configured to be deployed out of the aft end of the aircraft on command. When presented with the threat of in-coming surface-to-air or air-to-air missiles, the decoy must be rapidly deployed out of the aft end of the aircraft by extending out a towline from the aircraft. The decoy may be specifically configured to emit a signature such as a heat seeking image while the aircraft is in the threat area. The heat seeking image is ideally stronger than that produced by the aircraft. The decoy may also include apparatus to emit a radar signature which is greater than that produced by the aircraft.

Many prior art towed decoy systems are configured with the capability of deploying the decoy rapidly but are unable to retrieve the decoy. For such systems, it is necessary to sever the towline prior to landing of the aircraft such that the decoy is lost and therefore cannot be re-used. However, because the decoy itself is a costly item, it is desirable to reel the decoy back into the aircraft such that the decoy may be re-used on subsequent missions. Because of the manner in which surface-to-air and air-to-missiles are typically deployed in rapid succession, in the event that the first decoy is destroyed by a missile, it is necessary that another decoy be capable of being deployed behind the aircraft.

The system therefore creates an additional decoy for second and subsequent missile threats. In this regard, it is necessary that the decoy be capable of being extremely rapidly deployed. Even more specifically, in order to facilitate such rapid deployment of the decoy, it is necessary that the towline is capable of paying out in an extremely rapid manner. Retrieval of the decoy is desirable only after the aircraft has left the threat area. Decoy retrieval may be performed at a slower rate than decoy deployment.

One popular technique of deploying towed decoys involves the fixing of a spool at the aft of the aircraft to control the payout of the towline. The towline is wrapped about the spool and is allowed to be payed out through the use of a clutch mechanism as well as through the use of a mechanical braking mechanism to slow the rotation of the spool as the decoy nears the end of its payout. In certain payout systems of this type, rapid deployment of a towed decoy may be facilitated by utilizing a centrifugally applied brake coupled to the spool. The braking mechanism slows the rotation of the spool such that when the towline reaches the end of its payout, tensile forces exerted upon the towline by the aerodynamic drag of the decoy are kept within the towline's design limits. In this regard, the braking mechanism prevents the towline from snapping during deployment which would otherwise render the decoy irretrievably lost.

As was earlier mentioned, it is desirable that the decoy is recoverable back into the aircraft such that it may be re-deployed on subsequent missions. Another important factor in the rapid deployment of the decoy is the manner in which the towline is wound around the spool during retraction after an initial deployment. More specifically, it is desirable that the towline is evenly distributed across the spool during decoy retrieval in order to prevent the towline from cut-in through existing wraps of the towline about the spool.

If cut-in occurs, the towline may become wedged between adjacent wraps of towline which may prevent the free payout of the towline during a subsequent deployment of the decoy. A scenario wherein cut-in may occur is a situation where a decoy is first deployed and is recovered while the aircraft is moving at a low airspeed resulting in the towline being loosely wound around the spool (i.e., at a low tension). Cut-in may then occur if the decoy is redeployed when the aircraft is moving at a higher relative airspeed with resulting higher tension on the towline. The higher tension on the towline may result in cut-in between wraps of unevenly and loosely wound towline. In order to avoid the cut-in scenario, it is necessary to evenly wind the towline around the spool during decoy retrieval.

Aside from the above-mentioned limitations regarding rapid deployment and retrieval of decoys, other limitations exist in the prior art with respect to maintenance of towed decoy systems. For example, when the decoy is deployed, the towline is exposed to the turbulence of the air stream. In addition, during decoy deployment, the towline experiences constantly varying loads due to airspeed and acceleration changes of the aircraft. Furthermore, in some cases, the towline is exposed to hot exhaust gases generated by the aircraft engine(s). As a result of this exposure, the towline has a finite life that can vary from one to ten or more missions depending upon the severity of the environment experienced by the aircraft.

Thus, the towline must be replaced frequently. As such, it is desirable that the decoy system is easily maintenance insofar as the towline is easily replaced. It is also desirable to integrate the towline into an easily replaced modular element that also includes other wear-prone items such as the brake mechanism, slip ring assembly and towline sever blade in a manner wherein all such wear-prone items are replaced with the towline. In this manner, the quantity of maintenance actions on the remainder of the system may be reduced or eliminated.

Other limitations of prior art decoy systems include limitations of the towline. It should be noted that in addition to providing a means to connect the decoy to the aircraft, the towline also may include electrical and control lines running along the length of the towline which allow communications between the decoy and aircraft. It is desirable that the towline and, hence, the spool, is easily replaceable in the aircraft so that an appropriate towline configuration may be installed according to mission requirements. For example, it may be desirable to use a specific configuration of towline and decoy according to the type of anti-aircraft threats that are likely to be encountered during the mission.

For aircraft that are towing decoys, an additional limitation exists regarding safety wherein it is highly desirable that such towed decoys include a towline sever mechanism by which the decoy may be completely detached from the aircraft in the event that the decoy sustains damage from a missile or the decoy cannot otherwise be properly recovered. By including a towline sever mechanism, the decoy may be completely released from the aircraft such that the aircraft may safely land.

As can be seen, there exists a need in the art for a decoy system wherein the decoy may be deployed in extremely rapid manner in order to provide adequate protection against successive missile attacks. Additionally, there exists a need in the art for a decoy system wherein the decoy may be recovered at an end of each mission in order to save the costly decoy for later reuse. Furthermore, there exists a need in the art for a decoy system that facilitates rapid replacement of wear-prone components of the decoy system.

In addition, there exists a need in the art for a decoy system where the towline can be severed in the event that the decoy either is damaged or cannot be reeled in properly in order to allow the aircraft to safely land. Finally, there exists a need in the art for decoy system that is adapted to be installed within the narrow confines of military aircraft and which is of simple construction and of low cost.

BRIEF SUMMARY OF THE INVENTION

Provided is a reel-out reel-in apparatus which comprises a towed device such as an aerial decoy, and a towline cartridge which is configured to alternately reel out (i.e., deploy) and reel in (i.e., recover) the towed device. In its broadest sense, the towline cartridge includes a rotatable spool having a towline dispensibly wound therearound. Advantageously, the towline cartridge is specifically configured to be easily removable from an apparatus housing of the apparatus such that wear-prone items contained in the towline cartridge may be easily replaced.

Furthermore, the towline cartridge includes an electronically-controlled levelwind assembly which is adapted to evenly distribute the towline across a spool width of the spool during retrieval of the towed device. Such even or uniform distribution of the towline onto the spool is critical in preventing unwanted cut-in and cross-over of the towline into existing wraps on the spool. In this manner, subsequent deployment of the towed device is not compromised.

The apparatus may include a controller, a spool motor, a levelwind motor and various sensors which cooperate with one another to control the positioning of the levelwind assembly as well as controlling the winding in (i.e., reeling in) and paying out (i.e., reeling out) of the towline during towed device retrieval and deployment, respectively. The controller is electrically connected to the levelwind motor and to the spool motor and is operative to coordinate the operations thereof.

In this manner, the levelwind assembly is operated independently of the spool although the levelwind assembly is coordinated to complement reel in and reel out of the towline in a manner that will be described in greater detail below. The towline cartridge may include a braking mechanism and a cutter assembly which, along with the spool and towline as well as the levelwind assembly, may each be installed in the towline cartridge. The controller interfaces with the towline cartridge to control various operational aspects thereof. Various sensors such as Hall sensors are disposed in strategic locations on the apparatus. Such sensors provide input to the controller regarding various operational modes and components of the apparatus.

For example, the apparatus may include at least one sensor mounted on a forward end of the apparatus housing to sense the particular configuration or type of towline cartridge that is being interchanged or substituted into the apparatus. During initialization, the sensor(s) input is provided to the controller which is correlated to a preprogrammed look-up table of different types of towline cartridges. Each of the different types of towline cartridges may contain differing configurations (e.g., differing lengths and diameters of towline). The input regarding the identity of the towline cartridge is then used by the controller in regulating operation of the apparatus. For example, during deployment of the towed device, the controller may regulate the point at which the braking mechanism is activated to slow deployment of the towed device in accordance with the length and/or diameter of the towline.

The apparatus may further include at least one sensor mounted on a guide track of the apparatus housing in order to sense the relative position of the device launcher during deployment and/or retrieval of the towed device. Likewise, sensors may be mounted adjacent to the levelwind assembly in order to sense the position of a towline guide which controls the lateral position of the towline relative to the spool width during payout and rewinding of the towline. Finally, a sensor(s) may be mounted adjacent the spool to sense rotation of the spool during deployment and retrieval of the towed device. The various inputs sensed by the sensors may be provided to the controller to precisely regulate various operational characteristics of the apparatus. For example, sensors may count revolutions of the spool in conjunction with tracking the relative position of the levelwind assembly during towed device deployment such that the levelwind assembly may be moved into alignment with existing wraps of towline prior to towed device retrieval.

The towed device itself may be configured in a variety of shapes, sizes and configurations and may include electronics circuitry adapted to produce a number of tactical effects including generating signals that interfere with the operation of anti-aircraft weaponry such as surface-to-air or air-to-air missiles. The electronics circuitry may be adapted to receive and amplify interrogating radar signals such that the towed device generates a stronger radar signature than the aircraft to attract anti-aircraft weaponry to the towed device rather than to the aircraft. The towline cartridge is preferably adapted to be easily removed such that a new or refurbished towline cartridge may be readily installed via mechanical means onto the apparatus housing such as through the use of cartridge mounting fasteners. A removable cover plate may be provided in order to allow access to the interior of the cartridge housing such that the spool and levelwind assembly may be inspected and/or accessed.

The levelwind motor is configured to rotate the levelwind driveshaft which extends laterally into the cartridge housing and is threadably engaged to a towline guide to effectuate lateral translation of the towline guide. The levelwind motor may be a reversible stepper motor to provide precise, incremental rotation to the levelwind driveshaft so as to selectively position the towline guide. The towline guide is preferably moved to a center position of the spool width during payout of the towline to facilitate rapid reel out of the towline during towed device deployment.

As was previously mentioned, the sensing of the position of towline guide is facilitated by sensors such as Hall sensors. During retrieval of the towed device, the towline guide is moved from a center position (relative to the spool) to a position that is aligned with existing wraps of the towline on the spool (i.e., tangent point) at which time the towline guide resumes lateral back-and-forth motion to evenly and uniformly winds the towline back onto the spool. In this manner, the levelwind assembly mitigates or eliminates towline cut-in and/or cross-over which is a critical problem during retrieval of the towed device at low airspeed followed by subsequent re-deployment and retrieval of the towed device at high airspeed.

BRIEF DESCRIPTION OF THE DRAWINGS

These, as well as other features of the present invention, will become more apparent upon reference to the drawings wherein.

DETAILED DESCRIPTION

Figure 1:
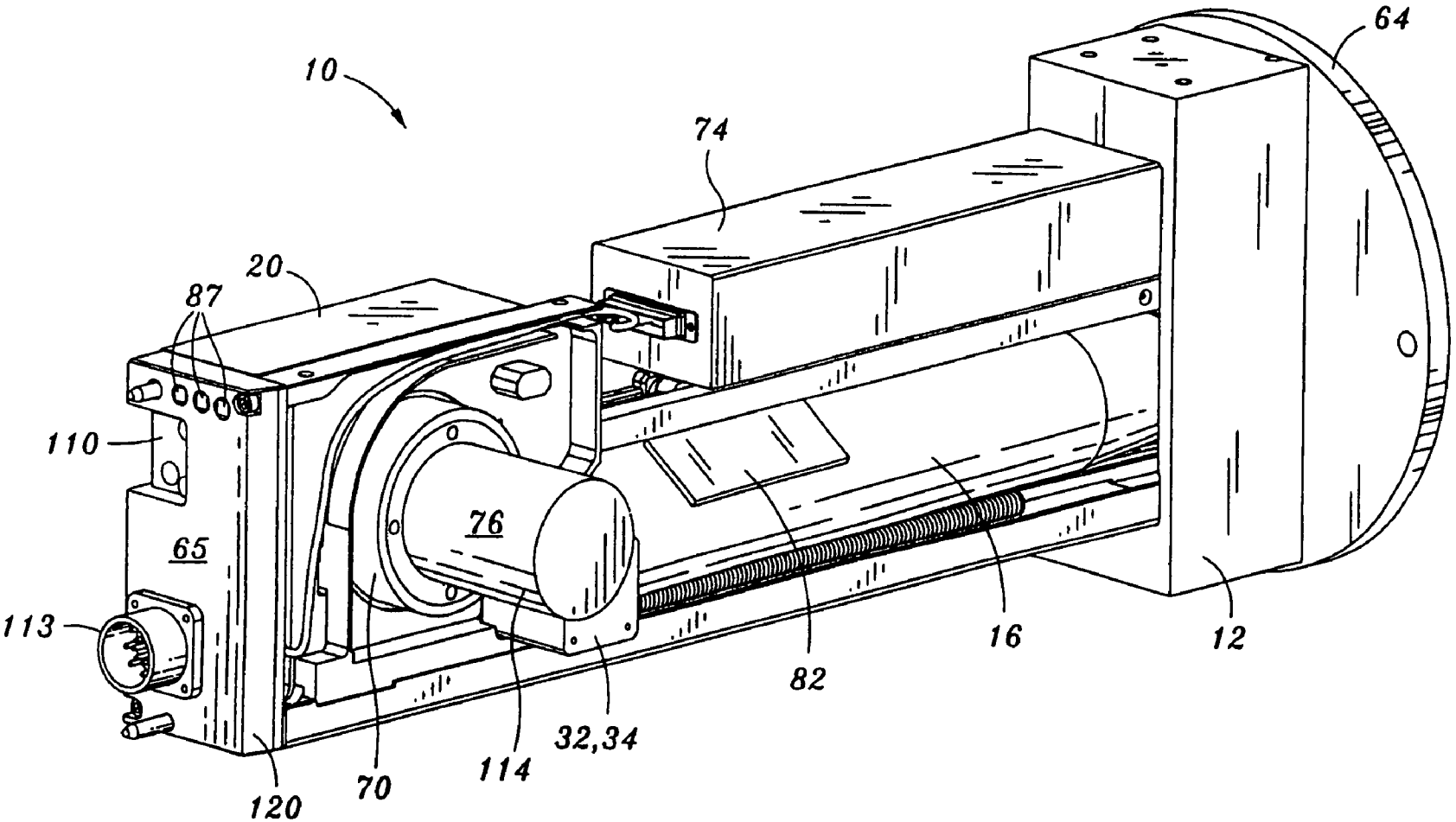
FIG. 1 is a front perspective view of a reel-out reel-in apparatus of the present invention constructed in accordance with an embodiment thereof.

Referring now to the drawings wherein the showings are for purposes of illustrating preferred embodiments for the present invention only and not for purposes of limiting the same, FIG. 1 perspectively illustrates a reel-out reel-in apparatus 10 of the present invention. The apparatus 10 is configured to rapidly reel out (i.e. deploy) and reel in (i.e. recover or retrieve) a towed device 16 such as an aerial decoy. In its broadest sense, the reel-out reel-in apparatus 10 comprises a spool 24, a towline 28 wound around the spool 24 and connected to the towed device 16, a drive mechanism for rotating the spool 24 during retrieval of the towed device 16, and an electronically controlled levelwind assembly 40.

Importantly, the levelwind assembly 40 is adapted to evenly distribute the towline 28 across a spool width 26 of the spool 24 during retrieval of the towed device 16. In addition, the apparatus 10 may include a towline cartridge 20 which contains (i.e., integrates) the spool 24, towline 28 and levelwind assembly 40 as well as a braking mechanism 72 into a single, replaceable unit. The towline cartridge 20 is specifically configured to be easily removable from the apparatus 10 such that wear-prone items including brake elements 120 (i.e., brake pads) of the braking mechanism 72 as well as the towline 28 may be easily replaced.

Figures 4, 5, 6:
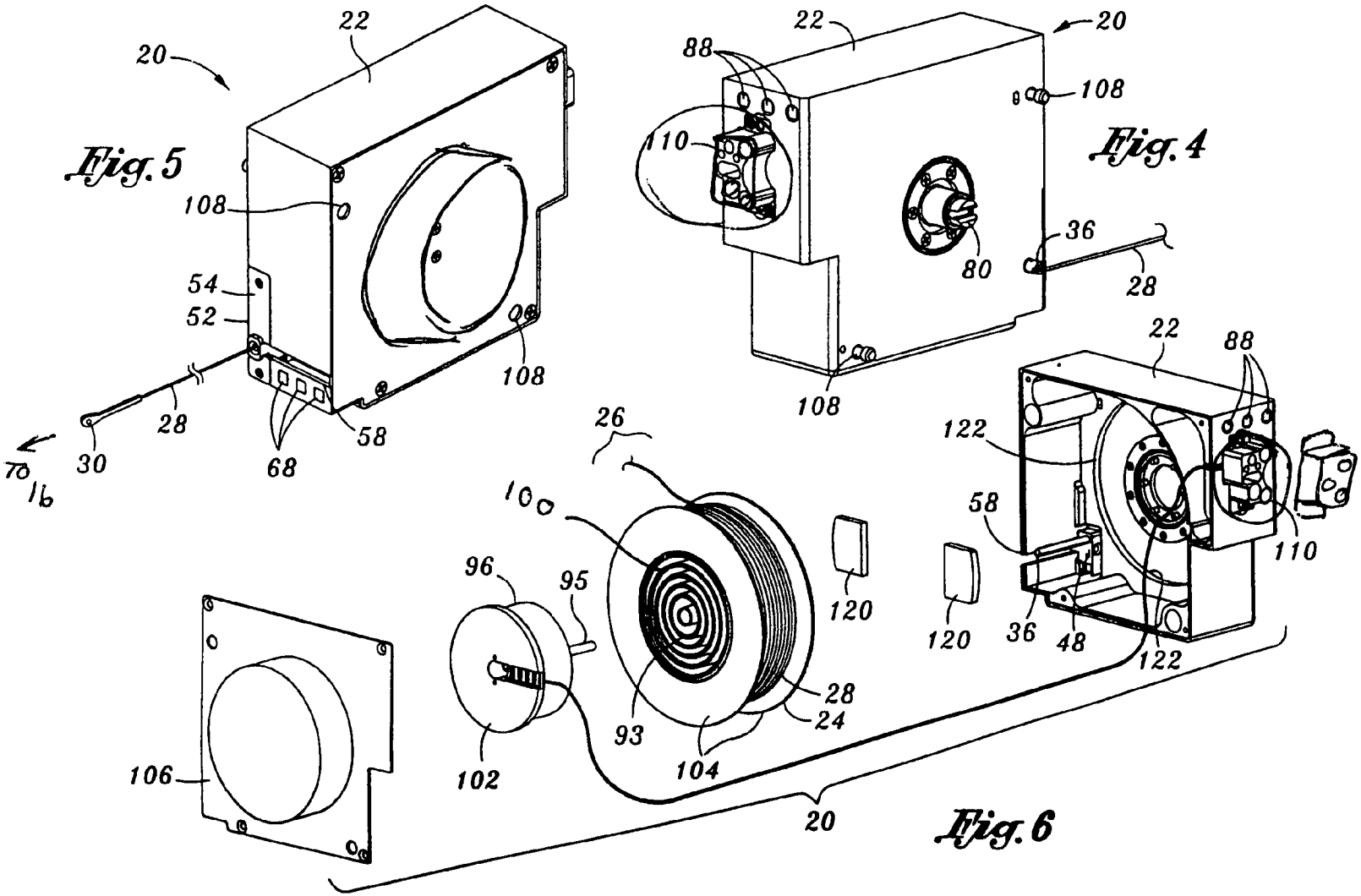
FIG. 4 is a perspective view of the towline cartridge having a cartridge housing illustrating a plurality of sensors mounted thereon for identifying the towline cartridge and further illustrating a spool driveshaft and a levelwind driveshaft extending into the cartridge housing.
FIG. 5 is a rear perspective view of the towline cartridge illustrating a slot formed in the cartridge housing and having a cutter assembly slidable along the slot to allow for lateral translation of the towline.
FIG. 6 is an exploded view of the towline cartridge illustrating the spool comprising an inner rotor, an outer rotor, a pair of spool flanges and the towline.
Figure 7:
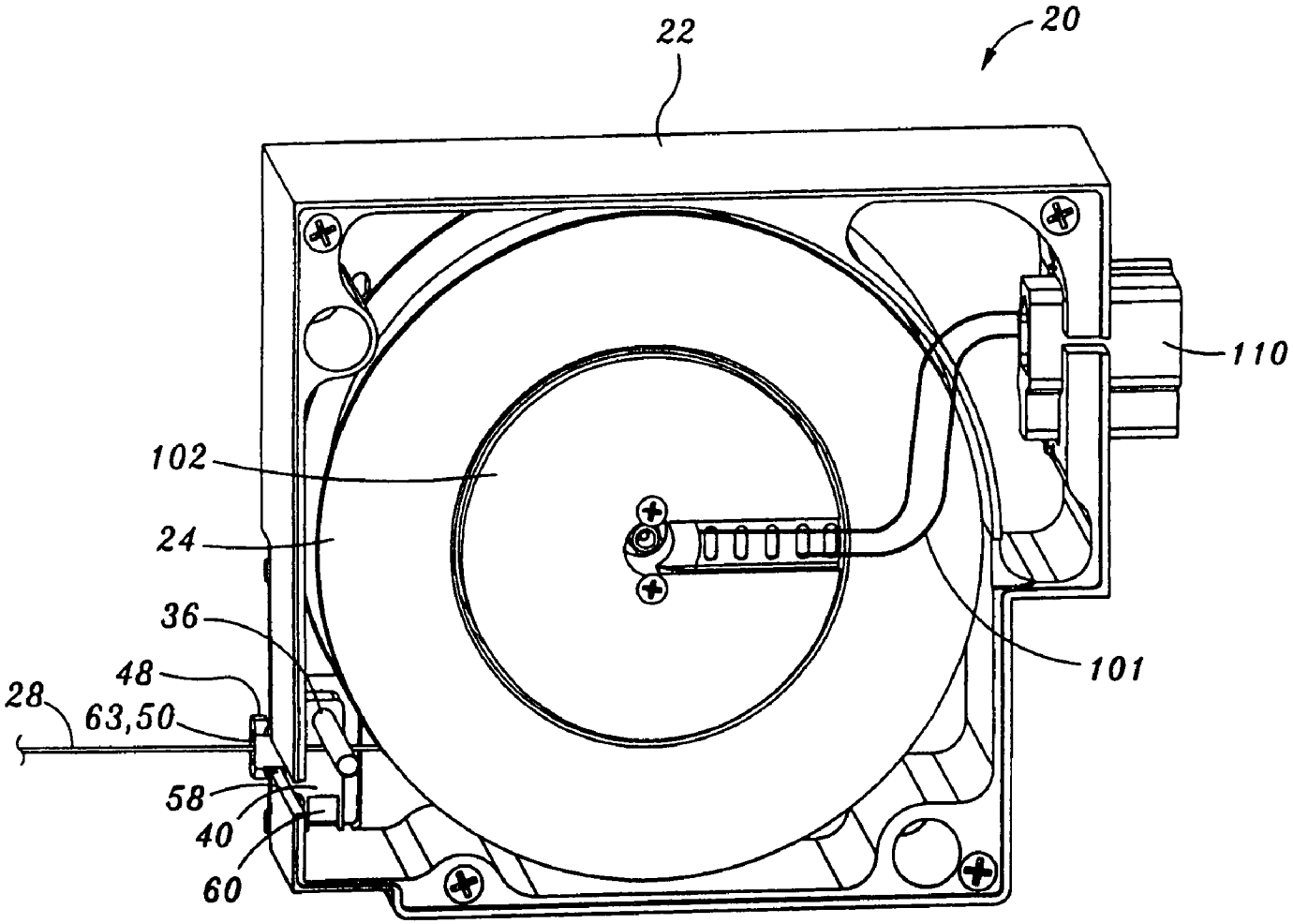
FIG. 7 is an enlarged partial perspective view of the levelwind assembly illustrating a towline guide and the levelwind driveshaft to which the towline guide is engaged.

Shown in detail in FIGS. 5-7 is the towline cartridge 20 includes the rotatable spool 24 having the towline 28 dispensibly wound therearound. The levelwind assembly 40 is specifically configured to move laterally back-and-forth relative to the spool 24 in order to evenly or uniformly distribute the towline 28 across the spool width 26. As was mentioned above, the even distribution of the towline 28 prevents cut-in of the towline 28 into existing wraps of towline 28 on the spool 24 during retrieval of the towed device 16. By eliminating or preventing cut-in, subsequent deployment of the towed device 16 will not be compromised due to unwanted binding of the towline 28 between the existing wraps of towline 28.

Other components of the apparatus 10 include a controller 74 (shown in FIGS. 1-3), a spool motor 76 (shown in FIGS. 1, 3), a levelwind motor 32 (shown in FIG. 1), a clutch mechanism 70 (shown in FIGS. 1, 3, 6), the braking mechanism 72 (shown in FIG. 6*a*), a cutter assembly 52 (shown in FIGS. 5, 7) and various connectors and sensors which cooperate with one another in order to control the positioning of the levelwind assembly 40 (shown in FIG. 8*a*) as well as control the reel-in and reel-out of the towline 28 during retrieval and deployment of the towed device 16. The levelwind motor 32 is operatively coupled to the levelwind assembly 40. Likewise, the spool motor 76 is operatively coupled to the spool driveshaft 80.

Referring to FIG. 1, at the aft end of the apparatus 10 is an external interface 64 which is configured to secure the aft end of the apparatus 10 to an aircraft. In addition, a forward external interface 65 of the apparatus 10 provides electrical connections and other connections from the aircraft to the apparatus 10. The controller 74 is mounted adjacent to the external interface 64 and acts to control the operation of the apparatus 10 in a manner which will be described in greater detail below. At the forward end of the apparatus 10 are connectors 111 and 113 which provides a means to connect the towline cartridge 20 to the aircraft. A breech plate 14 is provided in order to support connectors 110 and 113 that interface the apparatus 10 to the aircraft.

The towline 28 is wound around the spool 24 and extends off of the spool 24 at a tangent point on the spool 24. The towline connects the apparatus (i.e., spool 24) to the towed device 16. The drive mechanism (i.e., spool motor 76, etc.) is operatively coupled to the spool 24 and is configured to drivingly rotate the spool 24 for reeling in of the towline 28 during retrieval of the towed device 16. The levelwind assembly 40 is configured to uniformly distribute the towline 28 onto the spool 24 during retrieval of the towed device 16. As was earlier mentioned, the levelwind assembly 40 is configured to move the towline 28 back-and-forth across the spool 24 width during retrieval of the towed device 16.

During deployment of the towed device 16, the levelwind assembly 40 is configured to remain stationary relative to the spool width 26 during deployment of the towed device 16. Preferably, the levelwind assembly 40 is configured to be positioned at an approximate midpoint relative to the spool width 26 during deployment of the towed device 16. In this manner, as the towline 28 is reeled out (i.e., wound off of the spool 24 during deployment of the towed device 16), the towline 28 winds off of the spool 24 and is fed through a towline guide 48 which, preferably, is held stationary at the midpoint of the spool width 26.

To ensure uniform distribution of the towline 28 back onto the spool 24 during towed device 16 retrieval, the levelwind assembly 40 is preferably positioned to be aligned with the tangent point of the last towline 28 wrap as it extends off of the spool 24. Such positioning of the levelwind assembly 40 is facilitated through the controller 74 which is electrically coupled to the levelwind assembly 40. More specifically, the controller 74 is operative to count revolutions of the spool 24 during deployment of the towed device 16 and position the levelwind assembly 40 adjacent to the tangent point prior to towed device 16 retrieval. The controller 74 repositions the levelwind assembly 40 based upon total spool revolutions. In addition, the repositioning of the levelwind assembly 40 may be facilitated by taking into account the specific configuration of the towline 28 that is being reeled in. More particularly, the controller 74 may access a towline 28 configuration table that may be preprogrammed into the controller 74 software.

The controller 74 is then operative to position the levelwind assembly 40 adjacent to the tangent point based upon total spool revolutions during deployment as well as based upon the towline 28 configuration. For example, the preprogrammed towline 28 configuration table may include data correlating towline 28 diameter to towline 28 length. Using such data, the controller 74 is operative to regulate the rate of lateral back-and-forth movement of the levelwind assembly 40 in response to changes in towline 28 diameter during reel-in thereof. In addition, the controller 74 may be operative to coordinate the rate of lateral movement of the levelwind assembly 40 with the rotational speed with which the spool reels in the towline 28.

Figure 9:
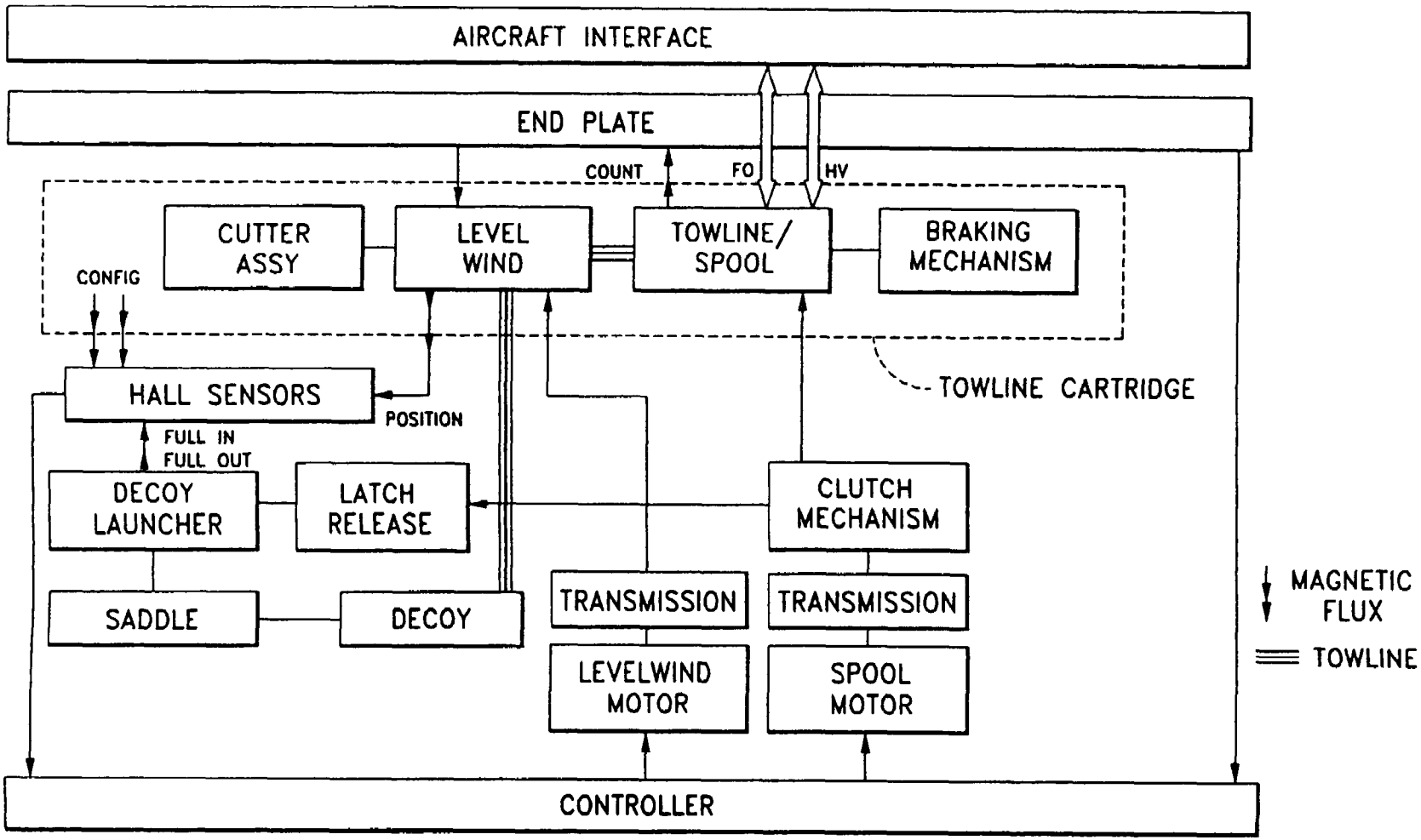
FIG. 9 is a block diagram of the apparatus including a controller for controlling various components of apparatus.

Referring to FIG. 9, shown is a block diagram illustrating the interconnection of various components of the apparatus 10. More specifically, FIG. 9 shows that the controller 74 is electrically connected to the levelwind motor 32 and to the spool motor 76. The spool motor 76 is, in turn, connected to the spool 24. The levelwind motor 32 is connected to the levelwind driveshaft 36. FIG. 9 also shows the braking mechanism 72, the spool 24, the levelwind assembly 40 and the cutter assembly 52 being integrated into the towline cartridge 20. The controller 74 interfaces with the towline cartridge 20 in the manner shown in the block diagram of FIG. 9.

As will be described in greater detail below, sensors such as Hall sensors disposed in strategic locations on the apparatus 10 provide input regarding various operational characteristics and modes of the apparatus 10. For example, the apparatus 10 includes Hall sensors 87 mounted on an integrated circuit board at the aft end of the apparatus 10. Such Hall sensors 87 are provided to sense magnets in the towline cartridge 20 that is being interchanged or substituted into the apparatus 10. Such configuration identifies the towline 28 configuration therein to allow controller 74 to apply the correct levelwind pitch during retrieval.

Furthermore, a set of Hall sensors 92, 94 may be provided on a guide track 86 of the apparatus 10 in order to sense the relative position of the device launcher 82 during deployment and/or retrieval of the towed device 16. In addition, a set of Hall sensors 68 may be included on the levelwind assembly 40 in order to sense the position of a towline guide 48 which controls the position of the towline 28 relative to the spool width 26 during reel in of the towline 28. Finally, the apparatus 10 may include a Hall sensor 90 configured to sense (i.e., count) the rotations of the spool 24 during deployment and retrieval of the towed device 16. As shown in FIG. 9, the Hall sensors 68 provide communication to the controller 74 via magnetic flux occurring between the components.

Figure 2A:
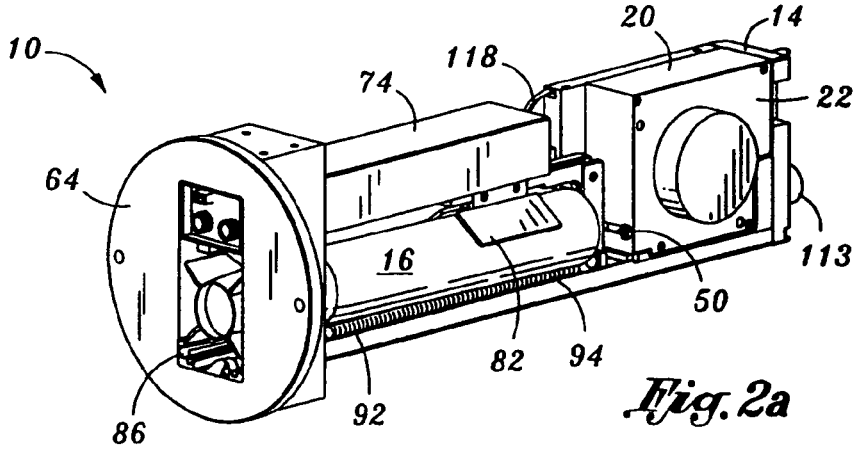
FIG. 2*a* is a rear perspective view of the apparatus having a towed device and a device launcher disposed in a full-in position prior to deployment of the towed device.
Figure 2B:
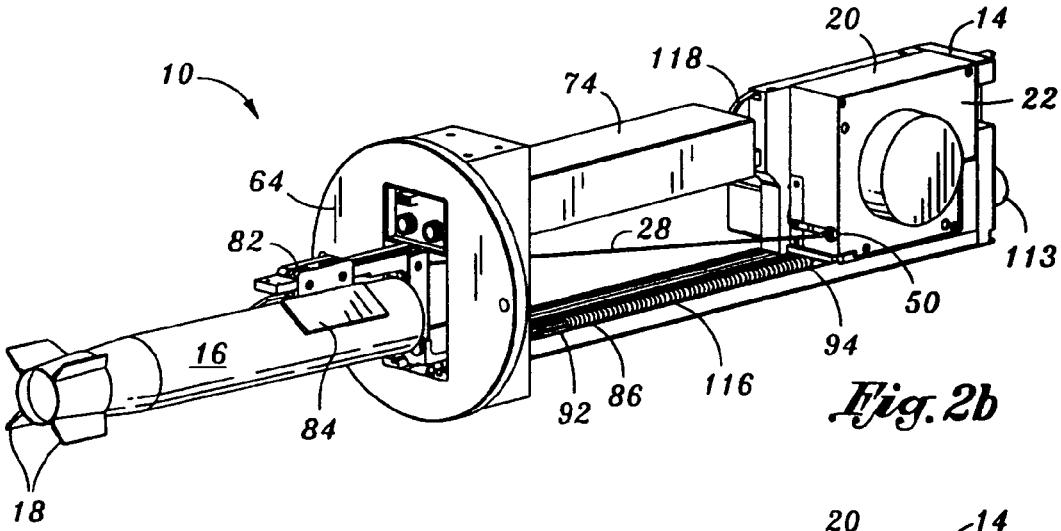
FIG. 2*b* is a rear perspective view of the apparatus showing the device launcher in a full-out position just prior to release of the towed device.
Figure 2C:
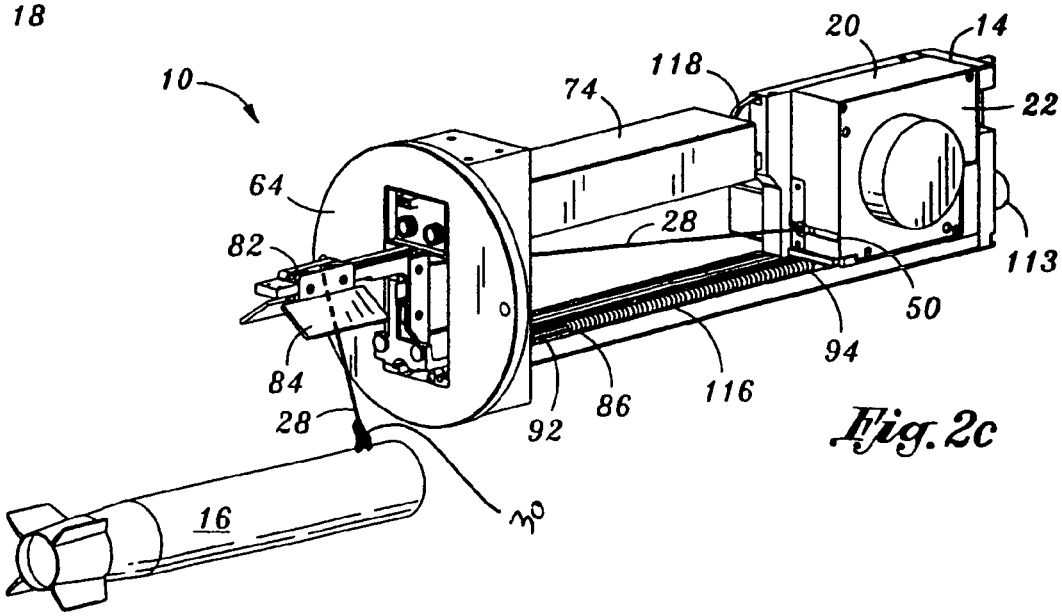
FIG. 2*c* is a rear perspective view of the apparatus after release of the towed device from the device launcher.
Figure 3:
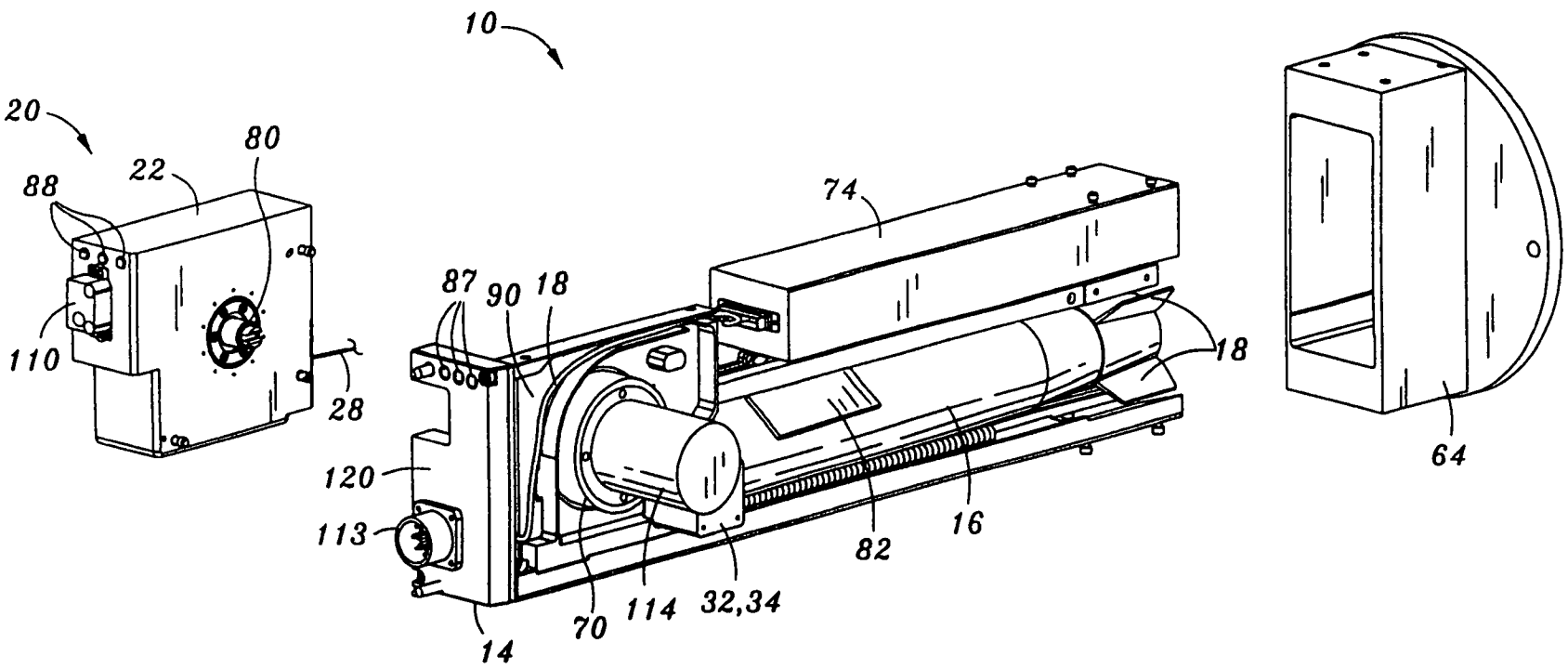
FIG. 3 is a partial exploded front perspective view of the apparatus illustrating a removable towline cartridge containing a towline wound around a spool and further containing a braking mechanism and a cutter assembly.

Referring briefly to FIGS. 2*a*-2*c* shown is the apparatus 10 with the towed device 16 in various stages of deployment. FIG. 2*a* illustrates the towed device 16 in its stored or recovered position prior to deployment wherein the towed device 16 is substantially contained within an apparatus housing 12. The apparatus housing 12 additionally provides structure upon which components of the apparatus 10 may be mounted. FIG. 2*b* illustrates the towed device 16 being positioned in an orientation wherein a device launcher 82 has moved to an aft position of the apparatus 10.

A support bracket 84 of the device launcher 82 acts to releasably engage and support the towed device 16 prior to the deployment thereof. FIG. 2*c* illustrates release of the towed device 16 whereby the support bracket 84 allows the towed device 16 to drop away from the device launcher 82. FIGS. 2*b*-2*c* illustrate sensors such as Hall sensors 92, 94 located at opposite ends of the guide track 86. The guide track 86 is incorporated into the apparatus housing 12 and is cooperatively engaged to the device launcher 82 such that the device launcher 82 may slide therealong during the deployment and retrieval of the towed device 16. A magnet located in the device launcher 82 causes Hall sensors to change state when positioned near them. At the forward end of the guide track 86 is the Hall sensor 92 which is adapted to provide input regarding whether the device launcher 82 is in a full-in position.

Likewise, a Hall sensor 94 is provided at the aft end of the guide track 86 and provides input regarding if the device launcher 82 is in the full-out position. Such input from the Hall sensors (i.e., full-in or full-out positions) is provided through the controller 74. As is known in the art, Hall sensors take advantage of the Hall Effect wherein a semi-conductor material is typically mounted on an object and a magnet is fixedly provided on another object. Movement of the object results in movement of the magnet which generates a change of state of the Hall sensor. In the case of the apparatus 10 of the present invention, the variation in the magnetic field is translated to the controller 74 in order to determine the position of the device launcher 82 relative to the guide track 86.

Referring to FIG. 2*c*, the towed device 16 may be configured in a variety of shapes, sizes and configurations other than that shown. For example, the towed device 16 may be configured as a generally elongated cylindrical object having a tapered tail section with a set of fins 18 disposed at an aft end thereof. Such fins 18 may be provided in order to aerodynamically stabilize the towed device 16 during deployment and while the towed device 16 is trailing the aircraft. The towed device 16 may include electronics circuitry which may be adapted to produce a number of tactical effects. For example, the electronics circuitry may be configured to generate signals that are intended to interfere with the operation of anti-aircraft weaponry.

Furthermore, the electronics circuitry may be adapted to receive and amplify interrogating radar signals. Such amplified radar signals allow for the generation of a stronger radar signature than the aircraft which thereby may attract anti-aircraft weaponry to the towed device 16 rather than to the aircraft. In addition, it is contemplated that the towed device 16 may include electronics circuitry which is configured to attract infrared guided missiles and/or heat seeking missiles such as surface-to-air missiles and air-to-air missiles. Furthermore, the electronic circuitry may include thermal energy systems which are configured to create an apparent target for the weapon in order to attract the weapon away from the aircraft. Other mechanisms may be integrated into the towed device 16 in order to lure anti-aircraft weaponry away from the aircraft.

Referring now more particularly to FIGS. 3-8, shown is the apparatus 10 having the towline cartridge 20 releasably engagable thereto. As was earlier mentioned, the towline cartridge 20 may be adapted to be easily removed such that a new or refurbished towline cartridge 20 may be readily inserted or installed onto the apparatus housing 12. As was earlier mentioned, the towline cartridge 20 is configured to rapidly reel out and reel in the towed device 16 and includes the rotatable spool 24 about which the towline 28 is dispensibly wound. The towline 28 may be configured to have electrical wiring and/or fiber optic cables extending along the length of the towline 28 in order to allow communication between the aircraft and the towed device 16.

The towline 28 may also be configured with a light-sensitive strength member extending at least partially, and more preferably, entirely, along the towline 28 length. In this regard, the towline cartridge 20 and, more specifically, the cartridge housing 22 is preferably configured to prevent light from entering the towline cartridge 20 and contacting the towline 28 contained therewithin such that the light sensitive strength member of the towline 28 does not degrade over time. Ideally, the cartridge housing 22 is specifically adapted to seal against light entering the towline cartridge 20 and contacting the towline 28.

Importantly, the towline cartridge 20 further includes the levelwind assembly 40 is specifically configured to move laterally back-and-forth relative to the spool width 26 in order to evenly and/or uniformly distribute the towline 28 across the spool width 26. As shown in FIGS. 2*a*-2*c*, the towed device 16 is adapted to be deployed through the aft end of the apparatus housing 12. The towline cartridge 20 is shown as being mounted at a forward end of the apparatus housing 12 which is opposite that from which the towed device 16 is deployed and recovered. As can be seen by referring to FIGS. 4-6, the towline cartridge 20 may be contained in a cartridge housing 22 which may be specifically adapted to contain or mount the spool 24 and levelwind assembly 40 therewithin.

As was earlier mentioned, the cartridge housing 22 may be adapted to be easily removable from the apparatus housing 12. In this regard, the towline cartridge 20 is preferably mechanically attachable to the apparatus housing 12 through the use of a pair of cartridge mounting fasteners 108 that may be extended through the cartridge housing 22 and into the apparatus housing 12 in order to quickly secure the towline cartridge 20 thereto. The cartridge housing 22 may include a cover plate 106 in order to allow access to the interior of the cartridge housing 22 such that the spool 24 and levelwind assembly 40 may be viewed and/or inspected.

Referring to FIGS. 5 and 6, the cartridge housing 22 may include a slot 58 formed laterally thereacross. The slot 58 is shown as being formed at an aft end of the cartridge housing 22. Preferably, the levelwind slot 58 is of equal or greater length than the spool width 26. Included with the levelwind assembly 40 is the towline guide 48 which may be mounted adjacent to the slot 58 along which the towline guide 48 may slide. The towline 28 may pass through the towline guide 48 and through the slot 58 before attaching to the towed device 16.

Figure 8:
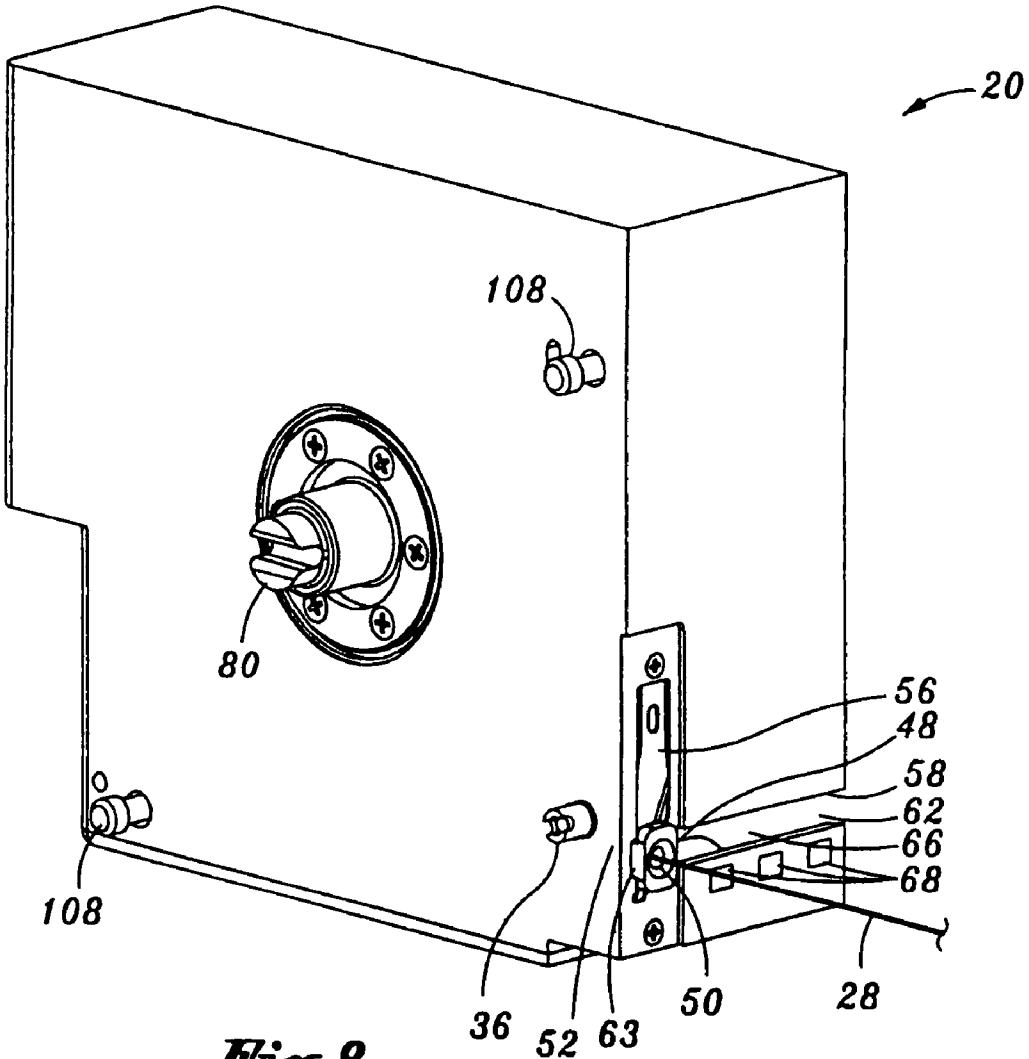
FIG. 8 is an enlarged perspective view of a cutter assembly for severing the towline.
Figure 8A:
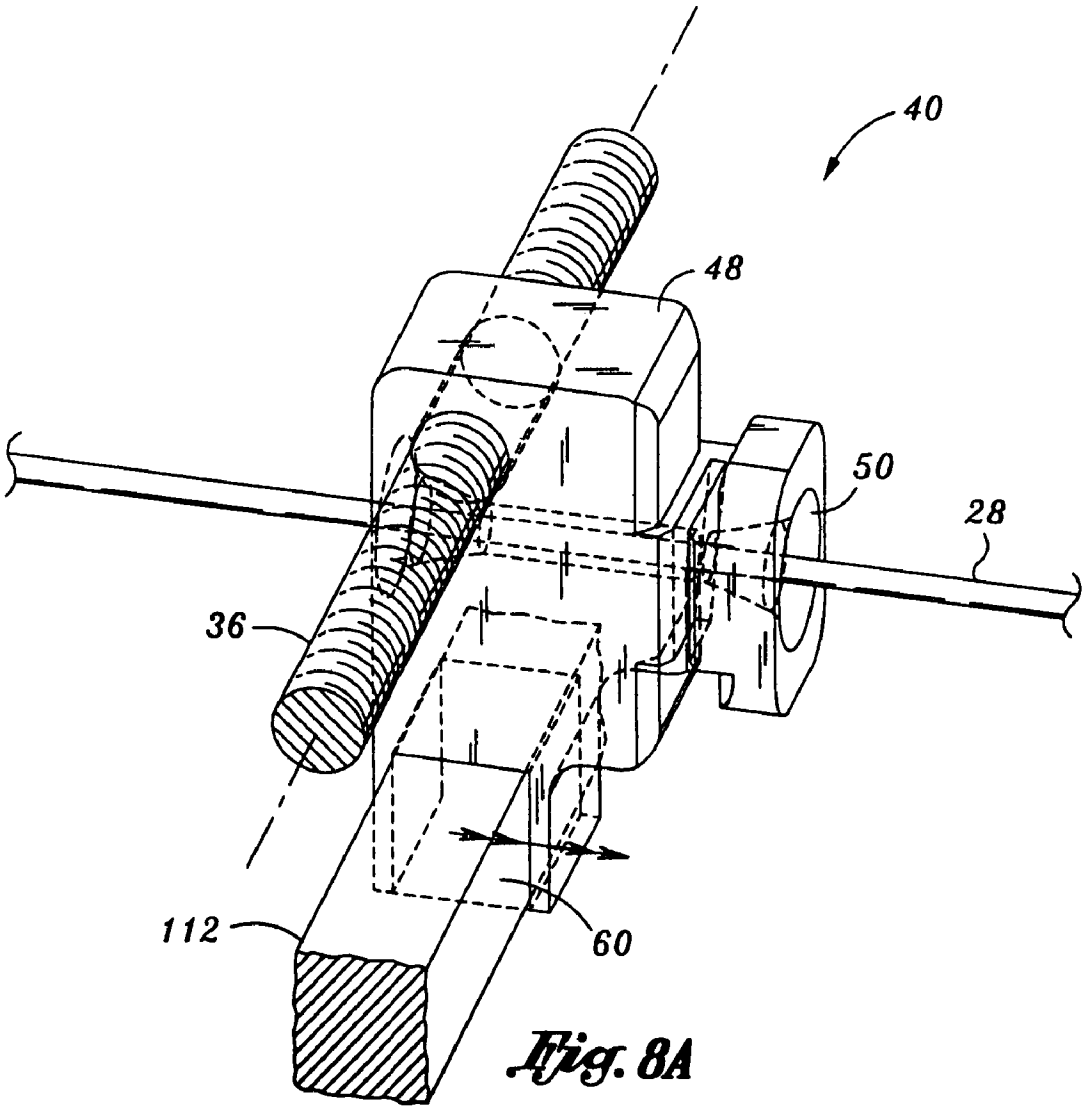
FIG. 8*a* is a perspective view of the levelwind assembly illustrating the towline guide and a guide bar along which the towline guide may slide.

Referring briefly to FIG. 8*a*, shown is the levelwind assembly 40 which includes the towline guide 48 having an eyelet 50 through which the towline 28 passes. A guide bar 112 may be included with the cartridge housing 22 to allow the towline guide 48 to slide therealong during its lateral translation as effectuated by the levelwind driveshaft 36. The eyelet 50 may have flared openings with narrowing in a middle portion of the eyelet 50. The eyelet 50 allows the towline 28 to easily pass therethrough regardless of pull-off angle at which the towline 28 extends from the spool 24. More specifically, if the towline guide 48 is in a center position 66 of the slot 58, resistance between the eyelet 50 and the towline 28 may be minimized due to the flared openings of the eyelet 50. The towline 28 may be secured to the towed device 16 by use of end fittings such as the formed end fitting 30 which may be molded or mechanically fastened to the towline 28.

Referring to FIGS. 7 and 8, shown is the towline guide 48 which is specifically configured to be movable back-and-forth laterally along the slot 58. As was earlier mentioned, the apparatus 10 may comprise the levelwind motor 32 which is operative to rotate the levelwind driveshaft 36 which extends laterally into the cartridge housing 22. The levelwind driveshaft 36 may be threadably engaged to the towline guide 48. In this manner, rotation of the levelwind driveshaft 36 effectuates lateral translation of the towline guide 48. It should be noted that the levelwind motor 32 is preferably a reversible motor such as a reversible stepper motor 34 although other motor configuration may be used. By configuring the levelwind motor 32 as a reversible stepper motor 34, precise incremental rotation may be provided to the levelwind driveshaft 36 so as to incrementally and selectively position the towline guide 48 precisely along the slot 58.

The levelwind assembly 40 may further include a carriage sensor assembly which is configured to sense the lateral position of a towline guide 48 relative to the spool width 26. As was described earlier, a plurality of sensors such as Hall sensors 68 may be integrated adjacent to or mounted upon the cartridge housing 22 at spaced locations below the slot 58. As shown in FIG. 8A, the Hall sensors 68 may cooperate with a magnet 60 which is mounted upon the movable levelwind assembly 40. As shown in FIG. 8, the slot 58 defines opposing end positions 62 and 63 and a center position 66 which is interposed between the end positions 62 and 63.

A pair of the Hall sensors 68 are mounted on the cartridge housing 22 adjacent to respective ones of the end positions 62 while another one of the Hall sensors 68 is mounted on the cartridge housing 22 adjacent to the center position 66. The magnet 60 generates a magnetic flux indicated by the double-arrowed vector shown in FIG. 8*a*. The magnet 60 thereby cooperates with the Hall sensors 68 in order to sense the lateral position of the towline guide 48. In this manner, the controller 74 may receive input from the Hall sensors 68 in order to track and control the location and movement of the towline guide 48.

In order to facilitate rapid reel out of the towed device 16 wherein the towline 28 is preferably rapidly wound off (i.e., reel out) of the spool 24, it is contemplated that the towline guide 48 is preferably moved to the center position 66 during payout of the towline 28. Movement of the towline guide 48 to the center position 66 is facilitated by the Hall sensors 68 cooperating with the magnet 60. In addition, it is contemplated that the towline guide 48 is adapted to be moved from the center position 66 to a position that is complementary to the existing winding of the towline 28 on the spool 24. More specifically, it is contemplated that the controller 74 is adapted to track the relative location of the windings of the towline 28 on the spool 24 during deployment during which time the towline guide 48 is moved to the center position 66.

Such tracking of the relative position of the existing windings on the spool 24 is facilitated by the use of a sensor such as a Hall sensor 90 which is mounted on the apparatus housing 12. The Hall sensor 90 may be disposed on a side opposite that which the cartridge housing 22 is installed. The Hall sensor 90 senses the positions of the spool 24 and is mounted on the apparatus housing 12 adjacent to the spool 24. As shown in FIG. 1, such Hall sensor 90 is generally located adjacent the forward end of the apparatus housing 12. However, it is contemplated that the Hall sensor 90 may be located in any position that allows tracking of the rotational motion and/or position of the spool 24.

The controller 74 receives and/or records input received from the Hall sensor 90 which is adapted to measure rotation of the spool 24. In cooperation with the Hall sensors 68 mounted on the cartridge housing 22, during retrieval of the towed device 16 or when the towline 28 is wound around the spool 24, the towline guide 48 is moved to a position relative to the spool width 26 that coincides with or is aligned with the last winding or wraps of towline 28 on the spool 24. By first aligning the towline guide 48 with the last position (i.e., tangent point) of the windings of the towline 28 on the spool 24, an even wrap of towline 28 onto the spool 24 is achievable.

Figure 6A:
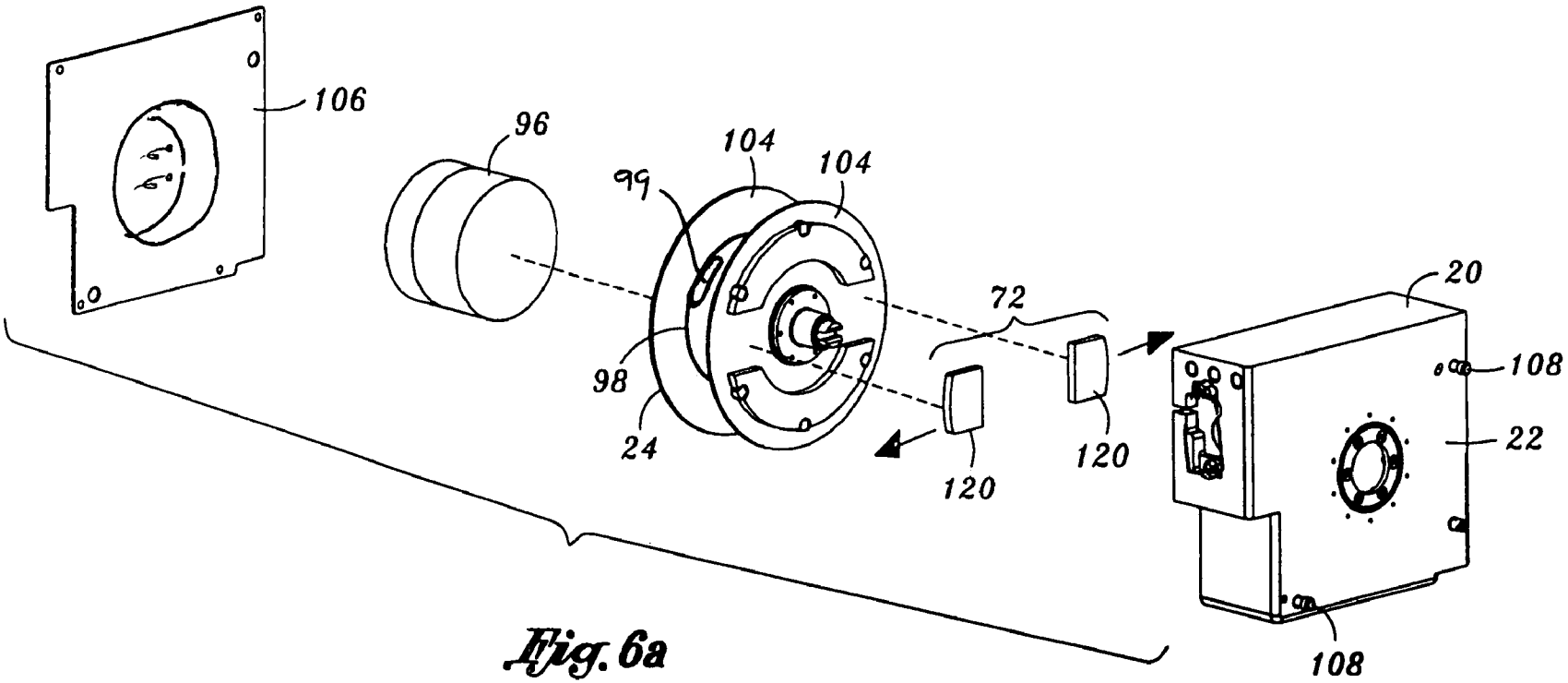
FIG. 6*a* is an exploded view of the towline cartridge and illustrating a pair of brake elements centrifugally slidable against an outer side of the spool such that the brake elements are engageable against a brake drum integrally formed with the cartridge housing.

The apparatus 10 may further include a clutch mechanism 70 which is operative to allow free rotation of the spool 24 during payout (i.e., reel out) of the towline 28. As was earlier mentioned, the towline guide 48 is preferably moved to the center position 66 of the slot 58 in order to simplify payout on the towline 28 during deployment of the towed device 16. Referring to FIGS. 5, 6 and 6A, the towline cartridge 20 may further include a centrifugal braking mechanism 72 having a pair of brake elements 120 (i.e., brake pads) and drum 122 which the brake elements 120 bear against. The drum 122 may be integrally formed with the towline cartridge 20.

The braking mechanism 72 is preferably configured to oppose rotation of the spool 24 during payout of the towline 28. Such opposition to the rotation of the spool 24 thereby regulates the payout speed of the towline 28 such that the towline 28 is capable of withstanding the relatively large tensile forces asserted thereupon during the rapid deceleration of the towed device 16 as it nears the end of its deployment. In this manner, the braking mechanism 72 prevents or reduces the tendency of the towline 28 to mechanically fail by snapping or breakage during deployment. The braking mechanism 72 may be integrated into the towline cartridge 20.

Referring back to FIGS. 5, 7 8 and 8A, the towline cartridge 20 can be seen as further including the cutter assembly 52 located adjacent one of the end positions 63 of the slot 58 (i.e., disposed beyond the spool width 26). The cutter assembly 52 may include a knife blade 56. A cutter cover 54 may be installed onto the cartridge housing 22 and is adapted to secure the knife blade 56 to the cartridge housing 22. The levelwind assembly 40 is preferably configured to selectively move the towline 28 into the cutter assembly 52 by driving the levelwind assembly 40 into the cutter assembly 52 in a manner to effectuate cutting or severing of the towline 28. As was earlier mentioned, such severing of the towline 28 may be necessary in the event of a malfunction of the spool 24 in order to allow for safe landing of the aircraft.

The operation of moving the levelwind assembly 40 into the cutter assembly 52 to sever the towline 28 is preferably regulated by the controller 74 which receives input regarding proper functionality of the spool 24. Furthermore, the controller 74 may be operative to receive signals regarding the overall operability of the apparatus 10 in order to provide necessary commands to sever the towline 28. Furthermore, the apparatus 10 is also preferably configured to sense the successful severing of the towline 28 and, if unsuccessful, the controller 74 is also operative to regulate movement of the towline guide 48 such that it may be repeatedly moved into the cutter assembly 52 until the towline 28 is successfully severed.

Referring now more particularly to FIG. 6, shown is the cartridge housing 22 and the spool 24 contained therewithin. As can be seen, the spool 24 comprises a spool rotor 98 with spool flanges 104 disposed on either side thereof. Located within the spool rotor 98 is a slip ring assembly 96 that serves to carry electrical signals from the towline 28 conductors to the stationary interface connector 110. In this manner, power and communication signals may flow directly from the interface connector 110 through interconnecting cable 101 to slip ring assembly 96 through the towline 28 to the towed device 16. The slip ring assembly 96 is comprised of a brush block assembly 100 and a commutator or assembly 102 and may be constructed in a manner similar to that disclosed in U.S. Pat. No. 4,852,455 issued to Brum, the entire contents of which are incorporated by reference herein.

The configuration of the slip ring assembly 96 allows for high voltage electrical signals to be communicated between the slip ring assembly 96 in both static and dynamic (i.e., rotational) modes of the spool 24. As was earlier mentioned, the specifics of the construction and methodology of the slip ring assembly 96 is illustrated in U.S. Pat. No. 4,852,455. At the center of the slip ring assembly 96 may be located fiber optic ferrules 95 and 93 which serve as an optical rotary joint capable of capable of carrying fiber optic communication signals from the connector 110 through the cable 101 and towline 28 to the towed device 16. The towline 28 passes to the brush block assembly 100 through a spool slot 99 formed in the spool rotor 98.

As shown in FIG. 6, the unique configuration of spool 24 provides a flat winding surface for most favorable treatment of the towline 28 wherein the number of wraps of towline 28 on the spool 24 is minimized. Furthermore, the spool 24 provides a relatively large diameter which allows for a simple, direct towline 28 path between the spool 24 and the towline guide 48 with a minimal number of turns and maximized bend radius of the towline 28. The unique configuration of spool 24 and the apparatus 10 minimizes towline 28 twisting during deployment and retrieval of the towed device 16. Importantly, the levelwind assembly 40 which is incorporated into the apparatus 10 mitigates towline 28 cut-in which is a critical concern during retrieval of the towed device 16 at low airspeed followed by subsequent re-deployment of the towed device 16 at high airspeed.

The operation of the apparatus 10 will now be described with reference to FIGS. 1-9. Magnets located on the cartridge housing 22 allow sensors 87 located in breech plate 14 to identify the specific type of towline 28 that is currently installed in the cartridge 20. Upon initialization, the controller 74 receives input regarding the configuration of the towline cartridge 20. Such input is correlated to a preprogrammed towline 28 configuration table (i.e., a look-up table) that identifies the characteristics of the towline 28. Such information regarding the identity of the towline cartridge 20 may include the overall length of the towline 28, the type of towline 28 and the diameters of the towline 28. The controller 74 uses such data in regulating the operation of the apparatus 10.

The apparatus 10 is installed into an aircraft typically at the aft end thereof and is carried aloft. During a mission where anti-aircraft weaponry is suspected or detected, a command may be manually and/or autonomously provided to the controller 74 to initiate deployment of the towed device 16 whereupon the device launcher 82 rapidly slides afterward along the guide track 86 until reaching the full-out position as indicated by Hall sensor 92. Such Hall sensor 92 may be disposed (e.g., bonded to) the guide track 86. At the full-out position, the towed device 16 is suspended outside of the aircraft. After release (i.e., dropping) of the towed device 16 from the device launcher 82, the towline guide 48 may be commanded to then move to the center position 66 of the slot 58 while the clutch mechanism 70 allows free-wheeling of the spool 24 and payout of the towline 28.

The towed device 16 is tethered to the aircraft by the towline 28. The aerodynamic drag forces cause rapid unwinding of the towline 28 as the towed device 16 accelerates away from the aircraft. Upon the spool 24 reaching a predetermined rotational speed the brake elements 120 apply forces to drum 122 to oppose rotational speed of the spool 24. The braking mechanism 72 thereby slows the deployment of the towed device 16 in order to minimize tensile forces therewithin to prevent towline 28 breakage as the towline 28 nears the end of its payout. As was earlier mentioned, during towed device 16 deployment, a Hall sensor 90 mounted adjacent to the towline cartridge 20 may count the number of rotations of the spool 24. The total rotational movement of the spool 24 is then relayed to the controller 74 and is used in determining when to re-set the clutch mechanism 70 thereby stopping the towed device 16 deployment at the desired length of towline 28.

As was earlier mention, the towed device 16 is preferably configured or adapted to create an apparent target to incoming weapons in order to attract such weapons away from the aircraft. Once the threat of the weapon ceases to exist, the towed device 16 may be recovered. The controller 74, acting in combination with the Hall sensors 68 and the magnet 60, moves the towline guide 48 from the center position 66 to a position that is in general alignment with the last full wrap of towline 28 on the spool 24 at the position where the spool 24 was stopped. This is determined using a preprogrammed towline 28 configuration table. Alignment is facilitated by the controller 74 by using input regarding total spool 24 rotation counted during the prior deployment of the towed device 16. The lateral positioning of the towline guide 48 is facilitated by operation of the levelwind motor 32 wherein the rotational action of the levelwind driveshaft 36 is translated into lateral motion of the towline guide 48 and, hence, lateral motion of the towline 28.

Once the towline guide 48 is moved into alignment with the outermost full wrap of towline 28 on the spool 24, the spool motor 76 rotatingly drives the spool 24 to reel in the towed device 16 by winding the towline 28 back onto the spool 24. Simultaneously, the levelwind motor 32 is configured to move the towline guide 48 laterally back-and-forth relative to the spool width 26 in order to evenly distribute the towline 28 across the spool width 26. As the towed device 16 nears the aircraft, it engages the support bracket 84 of the device launcher 82. Once the device launcher 82 engages the towed device 16, the device launcher 82 is moved forward along the guide track 86 in order to recover the towed device 16 to the interior of the apparatus housing 12. Input from the Hall sensor (i.e., full-in 94) on the guide track 86 indicates when the device launcher 82 is fully contained within the apparatus housing 12. At this point, the controller 74 halts further rotational motion of the levelwind motor 32 and spool motor 76.

In the event that there is a malfunction of the apparatus 10 such as may occur during deployment or retrieval of the towed device 16, the towline guide 48 may move past the end position 63 of the slot 58 in order to sever the towline 28 against the cutter assembly 52 and, more specifically, against the knife blade 56. As was mentioned above, the controller 74 is preferably adapted to allow for selective positioning of the towline 28 in either the center position 66 of the slot 58, such as during deployment of the towed device 16, or during any one of a plurality of positions between the end positions 62, such as during retrieval of the towed device 16.

The towline cartridge 20 is configured to be replaceable due to the use of the pair of cartridge mounting fasteners 108 which secure the towline cartridge 20 to the apparatus housing 12. When replacement of a towline cartridge 20 is desired, such as may be desirable in order to service the wear-prone items contained within the towline cartridge 20 (i.e., braking mechanism 72 comprised of brake elements 120 and drum 122, spool 24 and towline 28, and knife blade 56), the apparatus 10 may be removed from the aircraft such that the towline cartridge 20 may be replaced.

It is contemplated that the towline 28 may be of a constant diameter or a tapered thickness wherein the towline 28 may be thinner at the towed device 16 end and thicker at the end where the towline 28 attaches to the apparatus 10 near the aircraft. It is contemplated that the towline 28 is specifically manufactured to be capable of withstanding high levels of heat that may be produced by the engine exhaust of an aircraft.

The above description is given by way of example, and not limitation. Given the above disclosure, one skilled in the art could devise variations that are within the scope and spirit of the invention disclosed herein. Further, the various features of the embodiments disclosed herein can be used alone or in varying combinations with each other and are not intended to be limited to the specific combination described herein. Thus, the scope of the claims is not to be limited by the illustrated embodiments.

What is claimed is:

1. An apparatus for deploying and retrieving a towed aerial device from an aircraft, the apparatus comprising:

a rotatable spool having a spool width;

a towline wound around the spool and extending therefrom at a tangent point and being connected to the towed aerial device;

a drive mechanism operatively coupled to the spool and configured to drivingly rotate the spool for reel-in of the towline during retrieval of the towed aerial device; and an electronically-controlled levelwind assembly configured to uniformly distribute the towline onto the spool during retrieval of the towed aerial device, the levelwind assembly being configured to move the towline back-and-forth across the spool width during retrieval of the towed device and remain stationary relative to the spool width during deployment of the towed device, the levelwind assembly further being configured to remain at an approximate midpoint relative to the spool width during deployment of the towed device.

2. The apparatus of claim 1 further including:

a controller electrically coupled to the levelwind assembly; wherein:

the controller is operative to count revolutions of the spool during deployment of the towed device and position the levelwind assembly adjacent to the towline/spool tangent point prior to towed device retrieval based upon total spool revolutions.

3. The apparatus of claim 2 wherein:

the controller includes a preprogrammed towline configuration table;

the controller being operative to position the levelwind assembly in alignment with the towline/spool tangent point based upon total spool revolutions and towline configuration.

4. The apparatus of claim 3 wherein:

the preprogrammed towline configuration table includes data correlating towline diameter to towline length;

the controller being operative to regulate movement of the levelwind assembly in response to changes in towline diameter during reel-in thereof.

5. The apparatus of claim 1 further including a replaceable towline cartridge adapted to house the spool, the towline and the levelwind assembly, the replaceable towline cartridge being releaseably attached to the drive mechanism.

6. The apparatus of claim 5 wherein:

the towline includes a light-sensitive strength member that degrades when exposed to light;

the towline cartridge being configured to prevent light from entering the towline cartridge and contacting the towline contained therewithin.

7. An apparatus for deploying and retrieving a towed device, the apparatus comprising:

a rotatable spool having a spool width;

a towline wound around the spool and extending therefrom at a tangent point and being connected to the towed device;

a drive mechanism operatively coupled to the spool and configured to drivingly rotate the spool for reel-in of the towline during retrieval of the towed device;

an electronically-controlled levelwind assembly configured to uniformly distribute the towline onto the spool during retrieval of the towed device;

a cutter assembly disposed adjacent to the spool; and a controller being configured to drive the levelwind assembly toward the cutter assembly and to push the towline into direct contact with the cutter assembly to effectuate towline sever.

8. The apparatus of claim 7 wherein the cutter assembly includes a knife blade and the controller is configured to push the towline against the knife blade for severing the towline.

9. The apparatus of claim 7 wherein the controller is configured to repeatedly drive the levelwind assembly into the cutter assembly until the towline is severed.

10. The apparatus of claim 7 wherein the cutter assembly is disposed beyond the spool width and the controller is configured to push the towline beyond the spool width and into direct connect with the cutter assembly.

11. An apparatus for deploying and retrieving a towed device, the apparatus comprising:

a replaceable towline cartridge including:

a rotatable spool having a spool width;

a cutter assembly disposed beyond the spool width;

a towline wound around the spool and extending therefrom at a tangent point and being connected to the towed device; and an electronically-controlled levelwind assembly configured to uniformly distribute the towline onto the spool during retrieval of the towed device, wherein the levelwind assembly is configured to drive the towline into the cutter assembly to effectuate towline sever; and a drive mechanism releaseably attachable to the replaceable towline cartridge, the drive mechanism being operatively coupled to the spool and configured to drivingly rotate the spool for reel-in of the towline during retrieval of the towed device.

12. The apparatus of claim 11 wherein the towline cartridge further includes a braking mechanism operative to oppose rotation of the spool during towed device deployment.

13. The apparatus of claim 11 wherein:

the towline includes a light-sensitive strength member that degrades when exposed to light;

the towline cartridge being configured to provide a seal against light entering the towline cartridge and contacting the towline contained therewithin.

* * * * *